United States Patent [19]

Peterson

[11] 3,952,510

[45] Apr. 27, 1976

[54] FLOW SENSING AND CONTROL APPARATUS

[75] Inventor: Wayne A. Peterson, Joliet, Ill.

[73] Assignee: Caterpillar Tractor Co., Peoria, Ill.

[22] Filed: June 6, 1975

[21] Appl. No.: 584,426

[52] U.S. Cl. ..... 60/403; 60/405; 60/429; 60/430; 60/486; 180/141

[51] Int. Cl.[2] ..... F15B 13/09

[58] Field of Search ..... 60/403, 405, 428, 429, 60/430, 486; 180/79.2 R

[56] References Cited

UNITED STATES PATENTS

| | | | |
|---|---|---|---|
| 2,614,644 | 10/1952 | Gustafson | 180/79.2 R |
| 2,846,848 | 8/1958 | Coker | 60/429 |
| 3,154,921 | 11/1964 | Junck et al. | 60/429 |
| 3,547,559 | 12/1970 | Tittmann | 417/279 |
| 3,613,818 | 10/1971 | Schubert | 180/79.2 R |
| 3,631,937 | 1/1972 | Joyce | 180/79.2 B |
| 3,730,288 | 5/1973 | Dean | 180/79.2 R |
| 3,747,725 | 7/1973 | Feustel et al. | 180/79.2 R |

*Primary Examiner*—Edgar W. Geoghegan
*Attorney, Agent, or Firm*—O. G. Pence

[57] ABSTRACT

Flow sensing and control apparatus is provided to selectively combine the fluid output of an auxiliary pump with a hydraulic system. The apparatus includes a valve body having a primary pump passage therein through which fluid from one of a pair of primary pumps is conducted to its respective inlet of a control valve, an auxiliary pump passage interconnected between the auxiliary pump and the primary pump passage and a fluid receiving passage which is connected to the auxiliary pump passage. A pilot operated valve is disposed within the fluid receiving passage and operative in response to fluid flow through the primary pump passage for selectively controlling fluid to the fluid receiving passage so as to permit the combining of any available fluid from the auxiliary pump with that of the primary pump up to a predetermined minimum flow rate through the primary pump passage and for diverting any excess fluid from the auxiliary pump to the receiving passage above that necessary to maintain the minimum flow rate.

26 Claims, 2 Drawing Figures

19
12
18
27
14
22
23
25
26
34
52
46
53
10
36
45
40
33
58
50
43
38
60
49
41
57
35
42
63
62
47
61
69
54
37
26
66
25
56
67
68
15
16
31
P
P
P
ENGINE
30
21
14

19
18
27
14
22
23
25
26
80
83
53
34
52
45
61
62
50
81
43
40
41
84
49
38
42
33
87
54
47
36
93
86
91
37
88
26
56
90
66
69
67
68
15
16
30
31
P
P
ENGINE
P
21

FLOW SENSING AND CONTROL APPARATUS

BACKGROUND OF THE INVENTION

1. Field of the Invention

This invention relates to hydraulic systems and more particularly to a hydraulic steering system for a vehicle.

2. Description of the Prior Art

Hydraulically powered steering systems are frequently employed on vehicles, such as large earthmoving tractor-scraper vehicles and the like. One type of steering system frequently employed on such tractor-scraper vehicles utilizes two positive displacement pumps of different volumetric capacities and a control valve with a pair of inlets individually connected for receiving fluid from each pump separately. The control valve is adapted to use the small pump for maintaining a continuous minimum pressure on the steering jacks to provide quicker steering response and for making small steering corrections. The output of the large pump is freely unloaded to tank, except when being utilized for making large steering corrections which greatly enhances operating efficiency. Typical examples of this type of steering system are those disclosed in U.S. Pat. Nos. 2,614,644; 2,846,848, and 3,154,921.

The addition of an auxiliary pump to the above described two pump type steering system is quite difficult and encumbered with unique problems not found in other types of steering systems. Firstly, since there is no common source of fluid pressure, the output of the auxiliary pump cannot be merely combined with such common source. It is also not advantageous to just simply combine the output of the auxiliary pump with that of one or the other of the large or small pumps.

For instance, if the output of the auxiliary pump were combined solely with the small pump, the auxiliary pump would be made to work against a continuous back pressure because the output of the small pump is utilized to maintain the continuous minimum pressure on the jacks, as mentioned previously. This, of course, would adversely effect operating efficiency. Conversely, if the auxiliary pump were combined solely with the large pump, all of the output of the auxiliary pump would be unloaded to tank with the output of the large pump, except when large steering corrections are being made. Thus, in the event of a failure of the small pump, no fluid would be available for making small steering corrections and would adversely effect the normal steering characteristics of the steering system. As is obvious, this could further contribute to the hazards of an emergency situation and negate any safety benefit which the auxiliary pump is intended to provide.

OBJECTS OF THE INVENTION

Accordingly, it is an object of this invention to provide flow sensing and control apparatus for adding an auxiliary pump to a hydraulic steering system of the type having a control valve which is adapted to receive fluid from a pair of primary pumps through separate inlets.

Another object of this invention is to provide such flow sensing and control apparatus wherein the auxiliary pump is only pressurized when beneficially providing supplemental fluid needed by the steering system so as to provide greater operating efficiency.

Another object of this invention is to provide such flow sensing and control apparatus which is effective in automatically combining the fluid of the auxiliary pump with the steering system in a manner which retains the normal steering characteristics of the steering system to the greatest extent possible.

Other objects and advantages of the present invention will become more readily apparent upon reference to the accompanying drawings and following description.

DESCRIPTION OF THE PREFERRED EMBODIMENT

Figure 1:
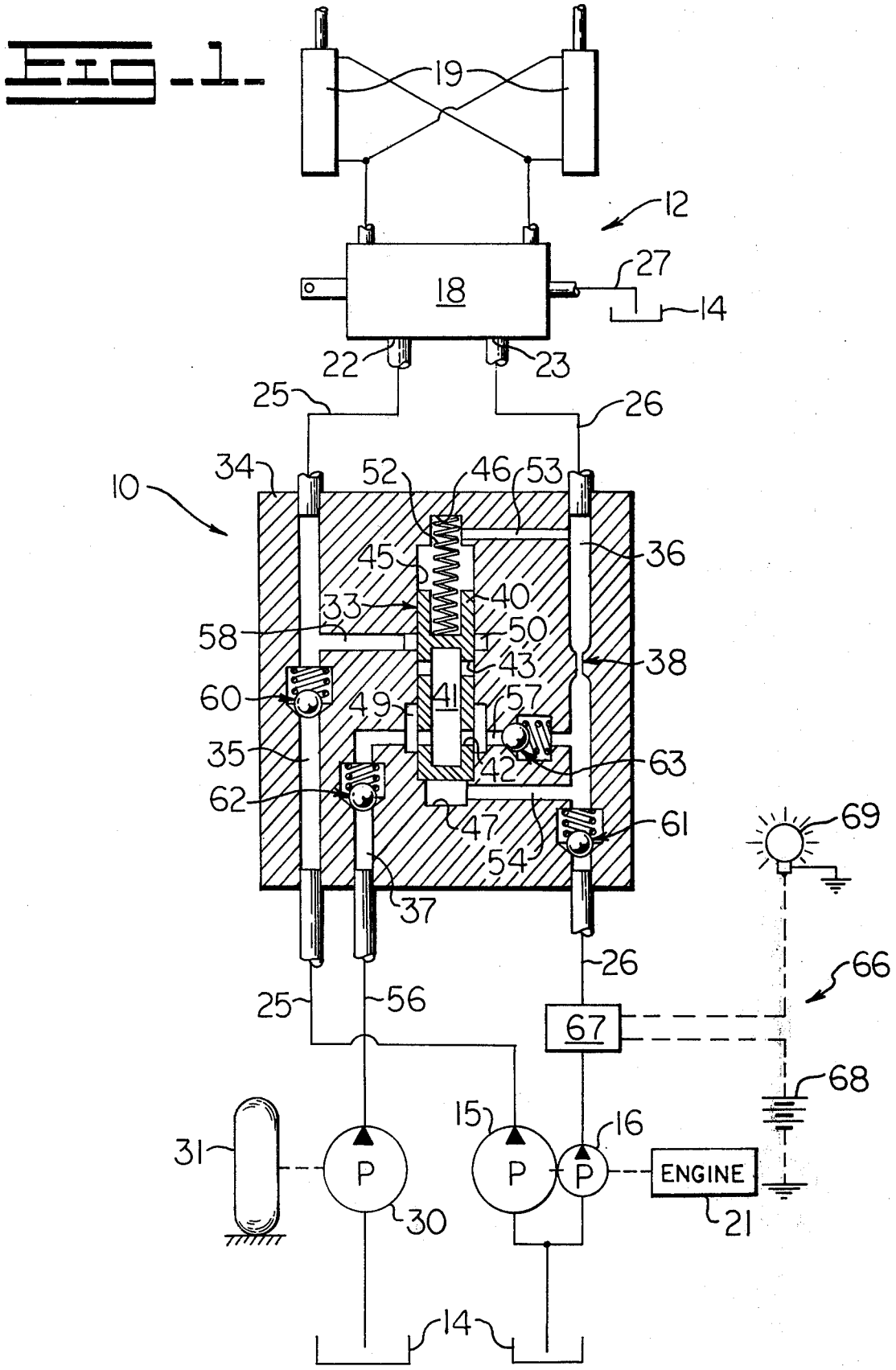
FIG. 1 is a cross sectional view of the flow sensing and control apparatus embodying the principles of the present invention in association with a hydraulic steering system, shown schematically.

Referring more particularly to the drawings, a flow sensing and control apparatus embodying the principles of the present invention is generally indicated at 10 in FIG. 1 in association with a hydraulic system, such as a double pump steering system 12 for a self-propelled vehicle, not shown.

The hydraulic steering system 12 includes a fluid reservoir 14, a pair of positive displacement primary pumps 15 and 16 connected for drawing fluid from the reservoir, a manually actuatable double pump steering control valve 18, and motor means, such as a pair of double acting jacks 19 connected for steering the vehicle. The pumps are provided with substantially different volumetric capacities with the pump 15 being the large pump and pump 16 being the small pump. Both the large and small pumps are operatively driven by an internal combustion engine, schematically shown at 21, of the vehicle.

The steering control valve 18 has a pair of inlets 22 and 23 for separately receiving fluid from the large and small pumps 15 and 16, respectively, via separate conduits 25 and 26. The control valve is preferably infinitely positionable and constructed for selectively directing fluid only from the small pump to the steering jacks 19 for making small steering corrections, while freely discharging fluid from the large pump back to the reservoir 14 via a conduit 27 and for variably combining fluid from the large pump with that of the small pump for making larger steering corrections. The steering control valve is also constructed so as to utilize fluid from the small pump to maintain a predetermined minimum pressure against the opposite ends of the steering jacks 19 to provide quicker steering response. The operation and construction of such control valve is more fully described in U.S. Pat. Nos. 2,614,644; 2,846,848, and 3,154,921.

In a manner hereinafter more fully described, a flow sensing and control apparatus 10 of the present invention is used for adding an auxiliary pump 30 to the hydraulic system for supplementing, as well as providing emergency fluid to the system in the event of a failure which causes the loss of fluid from either or both of the primary pumps. For this reason, the auxiliary pump 30 is ground driven, such as by the wheel schematically shown at 31 so as to make it independent of the engine 21.

In the preferred embodiment of the present invention, the flow sensing and control apparatus 10 includes a pilot operated flow control valve 33 which is disposed within a valve body 34. The valve body has a plurality of passages including a large pump passage 35, a small pump passage 36 and an auxiliary pump passage 37. The large and small pump passages 35 and 36 are individually disposed within the conduits 25 and 26, respectively, so that the fluid from their corresponding large and small pumps 15 and 16 is conducted therethrough. The small pump passage is provided with a fixed size orifice 38 for purposes hereinafter explained.

The flow control valve 33 includes an elongated valve spool 40 having an internal cavity 41 and two sets of radially disposed passages 42 and 43 communicating at predetermined axially spaced positions with the cavity. The valve spool 40 is slidably mounted within a valve spool bore 45 having opposite upper and lower closed ends 46 and 47 and a pair of axially spaced annuli including a first or lower annulus 49 and a second or upper annulus 50. The annuli are disposed intermediate the closed ends 46 and 47.

The spool 40 is movable in the bore between a first or blocking position in which it is shown and a second or open position wherein the radial passages 42 and 43 of the spool are positionable in alignment with respective ones of the annuli 49 and 50 so as to permit the communication of fluid between the annuli through the cavity 41 and the radial passages of the spool.

The valve spool 40 is biased towards its first position by a spring 52 and by the fluid pressure in the small pump passage 36 on the downstream side of the orifice 38. Such pressure is communicated against the upper end of the valve spool through a first pilot passage 53 interconnected betwen the small pump passage and the upper end 46 of the valve spool bore 45. Conversely, the valve spool is biased towards its second position by fluid pressure on the upstream side of the orifice which is communicated through a second pilot passage 54 interconnected between the small pump passage and the lower end 47 of the bore.

The auxiliary pump passage 37 is connected to the auxiliary pump 30 by a conduit 56 and to the first annulus 49 of the valve spool bore 45. To communicate fluid from the auxiliary passage to the small pump passage, a first passage 57 is provided which is interconnected between the first annulus 49 and the small pump passage 36. Such first passage is connected to the small pump passage at a position on the upstream side of the orifice 38. A second passage 58 is provided to interconnect the second annulus 50 with the large pump passage 35. Thus, auxiliary pump fluid in the auxiliary passage 37 is freely communicated to the small pump passage 36 via the lower annulus 49 and the first passage 57. However, fluid flow from the auxiliary pump passage through the second passage 58 into the large pump passage 35, which passages define fluid receiving passage means, is selectively blocked by the flow control valve 33.

The flow sensing and control apparatus 10 also includes a plurality of check valves 60, 61, 62 and 63. Check valve 60 is disposed within the large pump passage 35 on the upstream side of the connection of the second passage 56 with the large pump passage and the check valve 61 is disposed within the small pump passage ahead of passages 54, 57 or 53. Check valve 62 is likewise disposed within the auxiliary passage ahead of its connection with annulus 49. Such check valves are used to prevent the backflow of fluid to their respective pumps. The check valve 63 is disposed in the first passage 57 for preventing the loss of fluid from the small pump passage 36 to the large pump passage 35 through the flow control valve 33.

The flow sensing and control apparatus may also be provided with an electrical warning circuit 66 for warning the operator of the vehicle of a pump failure or the like. Such warning circuit preferably includes a flow sensing switch 67 which is disposed in series between a source of electrical energy, such as a battery 68, and a lamp 69. The flow sensing switch is operatively disposed within the conduit 26 ahead of the flow sensing and control apparatus 10 annd is effective in closing the circuit to the lamp whenever flow through such conduit falls below a predetermined level. It will be appreciated that a similar warning circuit may also be connected to the conduit 25 of the large pump for warning of its failure as well.

OPERATION OF THE PREFERRED EMBODIMENT

While the operation of the present invention is believed to be clearly apparent from the foregoing description, further amplification will be made in the following brief summary of such operation. In operation, the position of the valve spool 40 of the flow control valve 33 is effective in determining whether the output of the auxiliary pump 30 will be combined singly with the output of either the large pump 15 or the small pump 16 or in any desired combination therebetween. The positioning of such valve spool is responsive to the rate of fluid flow through the small pump passage 36. This is accomplished by the fixed size orifice 38 which creates a variable pressure differential acting against the opposite ends of the valve spool 40. It should be noted that while the orifice 38 is effective in creating such pressure differential, its size is not so small as to unduly restrict fluid flow to the control valve 18.

When flow through the small pump passage 36 is below a predetermined minimum flow rate, the cumulative force of the spring 52 and the downstream pressure exerted against the upper end of the valve spool 40 is designed to be greater than the upstream pressure exerted against the lower end of the valve spool. As a result, the valve spool will be forced to its first position which blocks any flow from the auxiliary pump 30 to the large pump passage 35. Consequently, all of such flow from the auxiliary pump is directed to the small pump passage 36 through the first passage 57. As the flow rate through the small pump passage increases beyond the minimum rate, the pressure on the upstream side of the orifice becomes increasingly greater than the pressure on the downstream side thereof. As a consequence, the force of the fluid pressure against the lower end of the valve spool is able to overcome the cumulative force of the spring and the downstream pressure against the upper end of the valve spool. This allows the valve spool to be shifted upwardly to its second position to permit the unloading of the auxiliary pump fluid to the large pump passage 35 through the second passage 58.

The force exerted by the spring 52 is preferably selected so that the minimum flow rate is below the output of the small pump 16 when the engine is operating in its normal speed range. Thus, the valve spool 40 will be in its second position during normal operation so as to unload the auxiliary pump fluid to the large pump passage 35. This is particularly advantageous in the steering system 12 illustrated herein because control valve 18 is adapted to freely unload any fluid conducted thereto through its inlet 22 to the reservoir 14, ,except when such fluid is needed for making large steering corrections. Thus, greater operating efficiency is achieved because the auxiliary pump is not working against a back pressure, except when needed for steering purposes.

As is readily apparent from the foregoing, the construction of the present apparatus is effective in selectively combining the output of an auxiliary pump with the inlets of a double pump steering control valve in a manner which is useful both during normal operating conditions and abnormal conditions.

Under normal conditions when the small pump 16 is providing fluid to the steering control valve 18 above the predetermined minimal flow rate, as is normally the case, the flow sensing and control apparatus 10 will be conditioned to unload the entire output of the auxiliary pump 30 to the large pump passage 35. When no or only small steering corrections are being made, the combined outputs of the large pump and the auxiliary pump are freely unloaded into the reservoir 14 through the control valve 18. When large steering corrections are being made, the output of the auxiliary pump is benefically used to supplement that of the large pump for making such steering corrections. It will be appreciated that this makes it practical to substantially reduce the size of the large pump, if desired, to reduce the overall cost of such system.

The greatest advantage of the present invention, of course, is the benefits it provides the steering system under abnormal conditions, such as the loss of the fluid output of one or both of the primary pumps or the loss of engine power making such pumps inoperative.

Firstly, in the case of the loss of the fluid output from the small pump, the resultant loss of differential pressure across the orifice 38 will shift the flow control valve spool 40 to its lower or first position. This will block the unloading of the auxiliary pump to the large pump passage 35 and cause it to be directed to the small pump passage 36 through the first passage 57. It will be appreciated that as long as the vehicle is moving at a speed sufficient to operate the auxiliary pump, such pump will normally provide sufficient fluid flow to substantially fully replace the loss of the small pump 16. Thus, the operator will still be able to make small steering corrections in the normal manner. If the output of the auxiliary pump is greater than that necessary to maintain the minimum flow rate, the valve spool will shift upwardly so as to unload the excess to the large pump passage 35.

Secondly, if the fluid output of the large pump is lost, the auxiliary pump will be diverted to the large pump passage 35 as during normal operation and thus be available whenever needed for making large steering corrections.

Lastly, if the output of both of the primary pumps is lost, the flow control valve will be shifted somewhere in between its first and second positions so as to divert whatever amount of the auxiliary pump fluid to the small pump passage 36 necessary to achieve the predetermined minimum flow rate therethrough and to divert any excess fluid to the large pump passage 35. Thus, it will be appreciated that fluid will be available to the control valve 18 for making both small steering corrections and large steering corrections. However, it will be appreciated that the apparatus is effective in giving first priority to the small pump passage 36.

It is important to note that in most failure situations, the steering response will be substantially the same as in the normal operating conditions so long as the vehicle is moving at an adequate speed. This is beneficial in any emergency situation because it alleviates handling problems in addition to any other critical problems the operator may have during such emergency situation.

ALTERNATE EMBODIMENT

Figure 2:
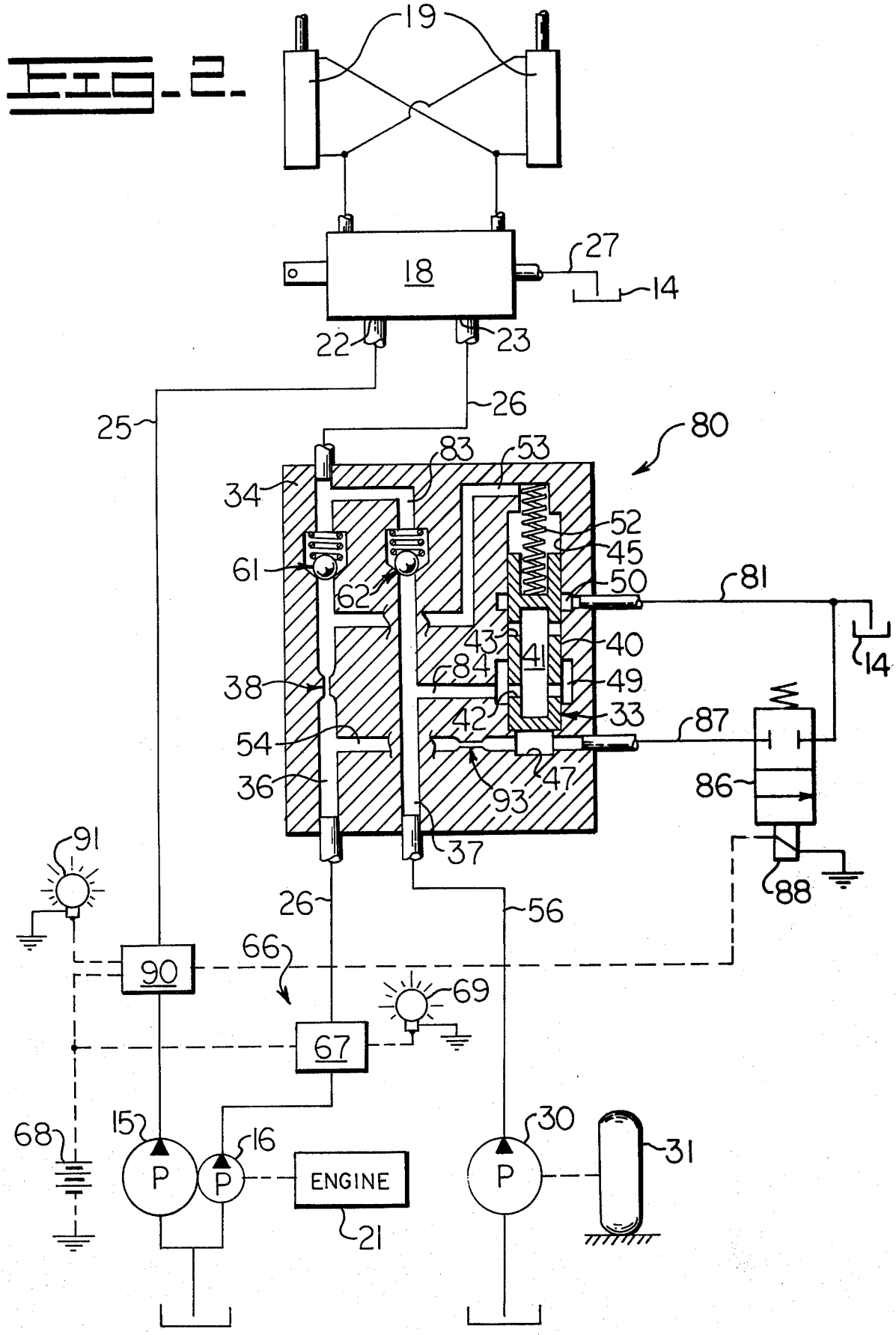
FIG. 2 is a view similar to FIG. 1, but showing an alternate embodiment of the flow sensing and control apparatus.

An alternate embodiment of the present invention is illustrated in FIG. 2 and includes a flow sensing and control apparatus 80 which differs in certain respects from the apparatus 10 of FIG. 1. In FIG. 2, the components which are identical to those previously described for the FIG. 1 embodiment are depicted by like numerals, even though they may not be specifically mentioned in the following detailed description, which will be directed primarily to the differences in the structures between the embodiments of FIGS. 1 and 2.

As is readily visible in FIG. 2, the major distinction of the flow sensing and control apparatus 80 is that, instead of the auxiliary pump 30 being unloaded to the reservoir through the control valve 18 by being combined with the fluid from the large pump 15, it is unloaded directly to the reservoir 14 through fluid receiving passage means including the flow control valve 33 and a conduit 81. As a result, the valve body 34 does not need the large pump passage 35 of the FIG. 1 embodiment.

Another distinction is the positioning of the check valve 61 in the small pump passage 36 on the downstream sides of the pilot passages 53 and 54 and the fixed size orifice 38. In addition, the auxilary pump passage 37 has a first branch passage 83 which is connected to the small pump passage 36 at a position downstream of the check valve 61. Such passage has the auxiliary passages check valve 62 disposed therein. A second branch passage 84 is connected to the lower annulus 49 of the valve spool bore 45.

The valve spool 40 of the flow control valve 33 is similarly movable from a first lower or blocking position in which it is shown to a second upper or open position for permitting the communication of fluid from the auxiliary pump 30 to the conduit 81 through the radial passages 42 and 43 and the central cavity 41.

The apparatus 80 also includes means for terminating any unloading of the auxiliary pump fluid to the reservoir in the event of a failure of the large pump 15. This makes such fluid available to the control valve 18 by causing it to be directed to the small pump passage 36 through the first branch passage 83. Such means includes a solenoid actuated, two-position valve 86 which is disposed in a conduit 87 interconnecting the lower end 47 of the valve bore 45 with the reservoir 14. The valve 86 is normally spring biased to a blocking position in which it is shown and actuated to an open position by a solenoid 88. The solenoid is electrically connected to a normally open flow sensing switch 90 which is disposed within the large pump conduit 25. The switch 90, in turn, is connected in series with the battery 68. An operator warning lamp 91 is also preferably connected to the switch so as to be energized thereby with the solenoid when the switch is closed due to low fluid flow through the conduit 25.

A flow restricting orifice 93 is provided in the upstream pilot passage 54 interconnecting the small pump passage 36 with the lower end of the bore 45. Such orifice is effective in limiting the amount of fluid loss from the small pump passage to the reservoir 14 when the valve 86 is shifted to its open position, as when the large pump fails as described above. The orifice, however, does not affect the communication of the fluid pressure against the lower end of the valve spool 40 when the valve 86 is in its closed position.

OPERATION OF THE SECOND EMBODIMENT

As will be apparent, the apparatus 80 of the FIG. 2 embodiment is effective in producing substantially the same results as the apparatus 10 of the FIG. 1 embodiment, while operating in a somewhat different manner.

The main distinction in such operation is the manner in which the output of the auxiliary pump 30 is directed to the steering control valve 18 in the event of a failure of the large pump 15. When such failure of the large pump occurs, the flow sensing switch 90 will close to energize the solenoid 88 of the valve 86. The solenoid, in turn, will shift the valve to its open position. This allows the pressure communicated against the lower end of the valve spool 40 through pilot passage 54 to be relieved to tank. As a result, the force of the spring 52 and the fluid pressure against the upper end of the valve spool will cause the spool to shift to its first position in which it is shown to prevent the unloading of the auxiliary pump to the reservoir 14 through the conduit 81. Thus, the output of the auxiliary pump is caused to be directed through the first passage 83 and into the small pump passage 36 so as to be conducted to the control valve 18 through conduit 26.

A second distinction is that in the event of a failure of the small pump 16, all of the output of the auxiliary pump will be directed to the control valve 18. This is because there will be no flow across the orifice 38 which will cause the valve spool 40 to be shifted to its first position. The same condition will exist if a failure of both of the primary pumps 15 and 16 occurs.

While the invention has been described and shown with particular reference to the preferred embodiments, it will be apparent that variations might be possible that would fall within the scope of the present invention which is not intended to be limited except as defined in the following claims.

What is claimed is:

1. Flow sensing and control apparatus, for use in combination with a hydraulic system including a pair of primary pumps and a control valve having a separate inlet for each of such pumps, to selectively combine the output of an auxiliary pump with such hydraulic system, comprising;

a valve body having a primary pump passage through which fluid from one of said primary pumps is conducted to its respective inlet of the control valve, auxiliary pump passage means interconnected between the auxiliary pump and said primary pump passage, and fluid receiving passage means connected to said auxiliary pump passage means; and pilot operated valve means disposed within said fluid receiving passage means and operative in response to fluid flow through said primary pump passage to selectively control the admission of fluid to the fluid receiving passage means so as to permit the combining of any available fluid from the auxiliary pump with that of the primary pump up to a predetermined minimum flow rate through the primary pump passage and to permit diversion to the receiving passage means of any excess fluid of the auxiliary pump above that necessary to maintain said minimum flow rate in the primary pump passage.

2. The apparatus of claim 1 including:

first check valve means disposed within said primary pump passage for preventing the backflow of fluid toward said primary pump; and second check valve means disposed within said auxiliary pump passage means for preventing the backflow of fluid toward said auxiliary pump.

3. The apparatus of claim 2 wherein said valve means includes:

a fixed sized orifice disposed within said primary pump passage for creating a variable pressure differential in such passage on the opposite upstream and downstream sides of said orifice;

a valve spool bore having opposite closed ends;

a valve spool slidably mounted within said bore between a first position and a second position;

a first pilot passage interconnecting said primary pump passage on the downstream side of said orifice with one end of said valve spool bore for biasing said valve spool toward its first position; and a second pilot passage interconnecting said primary pump passage upstream of said orifice with the other end of said valve spool bore for biasing said valve spool toward its second position.

4. The apparatus of claim 3 including:

a second primary pump passage in said valve body through which fluid from the other of said primary pumps is conducted to its respective inlet of the control valve;

a first passage interconnecting said auxilary passage means at a first position along said valve spool bore and with the first of said primary pump passages at a position on the upstream side of said orifice;

a second passage interconnecting the second primary pump passage with the valve spool bore at a second position therealong spaced from said first position; and passage means in said valve spool for communicating fluid from said first passage to said second passage when said spool is in its second position to unload fluid from the auxiliary pump to said second primary pump passage whenever flow in said first primary pump passage is above said predetermined flow rate and for blocking such communication when the valve spool is in its first position so as to direct the auxiliary pump fluid to the first primary pump passage when such flow is below said predetermined flow rate.

5. The apparatus of claim 4 including:

third check valve means disposed within said first passage intermediate said first primary pump passage and the valve spool bore for preventing fluid flow from the first primary pump passage to the second primary pump passage through said passage means of the valve spool and the second passage; and fourth check valve means disposed within said second primary pump passage upstream of connection of said second passage therewith for preventing backflow of fluid toward the other of said primary pumps.

6. The apparatus of claim 5 including spring means disposed within the one end of said valve spool bore for assisting in biasing said valve spool towards its first position.

7. The apparatus of claim 3 including:

a first branch passage of said auxiliary passage means interconnected to said primary pump passage downstream of said first check valve means and a second branch passage interconnected to said valve spool bore at a first position therealong, said first branch passage having said second check valve means therein;

drain means defining said fluid receiving passage means and interconnected with said valve spool bore at a second position therealong spaced from said first position; and passage means in said valve spool for communicating fluid from said second branch passage to said drain means to unload the auxiliary pump fluid whenever flow in said primary pump passage is above said predetermined minimum flow rate and for blocking such communication when the valve spool is in its first position so as to direct the auxiliary pump fluid to the primary pump passage through said first branch passage when such flow is below said predetermined minimum flow rate.

8. The apparatus of claim 7 including spring means disposed within the one end of said valve spool bore for assisting in biasing said valve spool toward its first position.

9. A hydraulic steering system for a self-propelled vehicle comprising;

a fluid supply reservoir;

a pair of positive displacement engine driven pumps connected for drawing fluid from said reservoir, said pumps being of different volumetric capacities to define a large pump and a small pump;

motor means connected for steering said vehicle;

a manually actuatable double pump steering control valve having a pair of inlets for separately receiving fluid from said small and large pumps, said control valve being positionable for selectively directing fluid only from said small pump to the motor means for making small steering corrections of the vehicle while freely discharging fluid from the large pump to the reservoir and for variably combining fluid from the large pump with that of the small pump for making larger steering corrections;

conduit means for individually connecting said small and large pumps with their respective inlets of the control valve;

an auxiliary ground driven pump; and flow sensing and control means connected to said conduit means and responsive to fluid flow from the small pump to its respective inlet of the control valve for selectively combining fluid from the auxiliary pump with that of the small pump whenever fluid flow to the small pump inlet is below a predetermined minimum flow rate.

10. The system of claim 9 wherein said flow sensing and control means includes;

a valve body;

separate large and small pump passages in the valve body through which fluid from the large and small pumps is communicated to their respective inlets of the control valve;

a valve spool bore having opposite closed ends and a pair of spaced annuli intermediate such ends;

a first passage interconnecting one of said annuli with said small pump passage;

a second passage interconnecting the other of said annuli with said large pump passage;

an auxiliary pump passage for communicating fluid from said auxiliary pump to said one annuli; and a flow control valve disposed within said bore and shiftable between first and second positions and having passage means therein for blocking communication between said annuli when said valve is in its first position and for permitting such communication when the valve is in its second position.

11. The hydraulic steering system of claim 10 wherein said flow sensing and control means includes:

a fixed size orifice disposed in said small pump passage downstream of the connection of said first passage therewith;

a first pilot passage disposed downstream of said orifice interconnecting one end of the bore with said small pump passage for biasing said flow control valve toward its first position;

a second pilot passage disposed upstream of said orifice to interconnect the other end of said bore with said small pump passage for biasing said control valve toward its second position;

spring means disposed within said bore for assisting the biasing of said control valve toward its first position.

12. The hydraulic steering system of claim 11 wherein said flow sensing and control means includes a plurality of check valves individually disposed within said large, small and auxiliary pump passages for preventing the backflow of fluid to their respective pumps, and disposed within said first passage for preventing the flow of fluid from said small pump passage to said large pump passage through said valve bore, the passage means of said flow control valve and said second passage.

13. The hydraulic steering system of claim 12 including an electrical warning circuit for indicating the failure of said small engine driven pump.

14. The hydraulic steering system of claim 13 wherein said warning circuit includes, in series, a source of electrical energy, a hydraulic flow actuated pressure switch, and a warning lamp, said switch being disposed within said conduit means between said small pump and said flow sensing and control means and operative to close said circuit for lighting said lamp when no fluid flow exists through said conduit means.

15. The hydraulic steering system of claim 9 wherein said flow sensing and control means includes:

a valve body;

a small pump passage in such valve body through which fluid from the small pump is communicated to its respective inlet of the control valve;

a valve spool bore having opposite closed ends and a pair of spaced annuli intermediate such ends;

an auxiliary pump passage through which fluid from the auxiliary pump is conducted and including a first branch passage connected to said small pump passage and a second branch passage connected to one of said annuli of said valve spool bore;

drain means connected to the other of said annuli of said valve spool bore; and a flow control valve disposed within said valve spool bore and shiftable between a first position and a second position and having passage means therein for communicating fluid between said annuli when said valve is in its first position and for blocking such communication when the valve is in its second position.

16. The hydraulic steering system of claim 15 wherein said flow sensing and control means includes:

a fixed size orifice disposed within said small pump passage upstream of said first branch passage;

a first pilot passage disposed downstream of said orifice interconnecting with one end of said valve spool bore for biasing said flow control valve toward its first position;

a second pilot passage disposed upstream of said orifice to interconnect the other end of said bore with said small pump passage for biasing said control valve toward its second position; and spring means disposed within said valve spool bore for assisting the biasing of said control valve toward its first position.

17. The hydraulic steering system of claim 9 wherein said flow sensing and control means includes first and second check valve means individually disposed within said small pump passage and said first branch passage of the auxiliary pump passage for preventing the backflow of fluid to their respective pumps.

18. The hydraulic steering system of claim 16 including failure sensing and control means for automatically shifting said spool to its first position however a failure occurs in said large pump so as to direct fluid from the auxiliary pump to the small pump passage through the first branch passage.

19. The hydraulic steering system of claim 18 wherein said failure sensing and control means includes;

means interconnecting said other end of the valve spool bore with said drain means including a normally closed solenoid operated control valve for blocking fluid to said drain means;

an orifice disposed within said second branch passage for limiting fluid flow from the auxiliary passage to said other end of the valve spool bore; and an electrical circuit including a flow sensing switch disposed within said conduit means between said large pump and said control valve for actuating said solenoid control valve to its open position whenever fluid from said large pump falls below a predetermined minimum flow rate.

20. The hydraulic steering system of claim 19 including visual warning means for indicating the failure of either of the large or small pumps.

21. The hydraulic steering system of claim 20 wherein said visual warning means includes another flow sensing switch disposed in said electrical circuit in parallel with the first of said flow sensing switches for sensing fluid flow from said small pump and a pair of lamps disposed within said electrical circuit for actuation by their respective flow sensing switches for individually indicating the failure of either of the large or small pumps.

22. In a hydraulic steering system of the type having two engine driven pumps of different volumetric capacities defining a large pump and a small pump, a double pump steering control valve with two fluid inlets, and a pair of conduits to individually connect each of the pumps with a respective one of the inlets of the control valve, and wherein the control valve is effective in utilizing the output of only the small pump for making small steering corrections while freely discharging the output of the large pump and variably combining the output of the large pump with that of the small pump for making larger steering corrections, the combination comprising:

an auxiliary ground driven pump; and flow sensing and control means connected to said auxiliary pump and disposed witih each of said conduits, said means being responsive to fluid flow through the small pump conduit and operative to selectively communicate any available output of the auxiliary pump to the small pump conduit until a predetermined minimum flow rate sufficient for making small steering corrections is satisfied and to communicate any excess output thereof to the large pump conduit.

23. The combination of claim 22 wherein said flow sensing and control means includes:

a valve body having a large pump passage, a small pump passage and an auxiliary pump passage through which fluid from the large, small and auxiliary pump, respectively, is communicated and passage means individually interconnecting said auxiliary pump passage with said small pump passage and the large pump passage;

pilot operated valve means disposed within said passage means for selectively blocking the communication between said auxiliary pump passage and said large pump passage; and a plurality of check valve means individually disposed within each of said pump passages upstream of their respective connections with said passage means for preventing the backflow of fluid toward their respective pumps.

24. The combination of claim 23 wherein said passage means includes a valve spool bore having opposite closed ends and a pair of spaced annuli intermediate such ends with said auxiliary passage being connected to one of said annuli, a first passage interconnecting said one annulus with said small pump passage and a second passage interconnecting the other of said annuli with said large pump passage; and wherein said pilot operated valve means includes an elongated valve spool slidably mounted within said bore between a first position for blocking communication between said annuli and a second position for permitting such communication.

25. The combination of claim 24 wherein said flow sensing and control means includes means for selectively shifting said valve spool between its first and second positions in response to fluid flow through said small pump passage comprising:

a fixed sized orifice disposed within said small pump passage at a position downstream of the connection of the first passage with such small pump passage, which orifice is effective in creating a variable pressure differential in the small pump passage in response to fluid flow across such orifice;

a first pilot passage for communicating the fluid pressure on the downstream side of said orifice with one end of said valve spool bore for biasing said valve spool towards its first position;

a second pilot passage for communicating the fluid pressure on the upstream side of said orifice with the other end of said valve spool bore for biasing said valve spool towards its second position; and spring means disposed within said bore for assisting the biasing of said control valve towards its first position so that a predetermined pressure differential is necessary before the valve spool shifts to its second position at which said predetermined minimum flow rate exists through said small pump passage.

26. The combination of claim 25 wherein said flow sensing and control apparatus includes check valve means disposed within said first passage to prevent fluid flow toward said one annulus of the valve spool bore to prevent the loss of fluid from the small pump passage through the passage means to the large pump passage.

* * * * *

Disclaimer 3,952,510.—*Wayne A. Peterson,* Joliet, Ill. FLOW SENSING AND CONTROL APPARATUS. Patent dated Apr. 27, 1976. Disclaimer filed Jan. 16, 1984, by the assignee, *Caterpillar Tractor Co.*

Hereby enters this disclaimer to claims 1, 2, and 3 of said patent.

[*Official Gazette March 20, 1984.*]